US006305820B1

(12) United States Patent
Poon

(10) Patent No.: US 6,305,820 B1
(45) Date of Patent: Oct. 23, 2001

(54) TELESCOPIC LANTERN

(75) Inventor: Tit Wing Poon, Shatin (HK)

(73) Assignee: Tupor Limited, Shatin (HK)

( * ) Notice: Subject to any disclaimer, the term of this patent is extended or adjusted under 35 U.S.C. 154(b) by 0 days.

(21) Appl. No.: 09/577,808

(22) Filed: May 24, 2000

(30) Foreign Application Priority Data

Feb. 13, 2000 (CN) ..... 00 20 1 694

(51) Int. Cl.[7] ..... F21L 4/00
(52) U.S. Cl. ..... 362/186; 362/372; 362/394
(58) Field of Search ..... 362/186, 181, 362/180, 162, 203, 158, 188, 372, 306, 394, 395

(56) References Cited

U.S. PATENT DOCUMENTS 4,520,431 5/1985 Fanelli et al. .
4,680,682 7/1987 Parker .
4,926,297 5/1990 Masters et al. .
5,424,928 * 6/1995 Jordan ..... 362/162
5,758,949 8/1998 Van Deursen .
6,030,094 * 2/2000 Sedovic ..... 362/203

* cited by examiner

*Primary Examiner*—Alan Cariaso
*Assistant Examiner*—Hargobind S. Sawhney
(74) *Attorney, Agent, or Firm*—Fulbright & Jaworski, LLP

(57) ABSTRACT

A lantern, which is telescopic, floatable and waterproof, includes a base 1, a telescopic shade 2, a decorative cover 3, a top cover 4, a handle 5, a waterproof ring 6, a socket support 7, a spring 8, a connecting ring 9, characterized in that the telescopic structure of the telescopic shade 2 is such that it has vent hole 2-6, and spring 8, and the electric circuit switch is a contact switch so that when the telescopic shade 2 rises up to a level that the circuit on the socket support 7 contacts the underside of the upper cap of the base 1, the circuit is switched on and the lantern is lighted, and when the telescopic shade 2 is pressed downward and the socket support 7 is separated from the upper cap of the base 1, the lantern is turned off. The waterproof ring 6 is provided in the recess of the outside of the lower part of the telescopic shade 2 so that the lantern is telescopic, floatable and waterproof. The present lantern has a beautiful appearance, a compact structure and a wide use.

8 Claims, 9 Drawing Sheets

7A

7B

TELESCOPIC LANTERN

FIELD OF THE INVENTION

The present invention relates to a lantern, and in particular to a floatable, waterproof and telescopic lantern (FWCL).

BACKGROUND OF THE INVENTION

There are a variety of lanterns such as waterproof lanterns, telescopic lanterns etc., but are short of floatable, waterproof and telescopic lanterns.

SUMMARY OF THE INVENTION

The objective of the present invention is to provide a structurally floatable, waterproof and telescopic lantern.

The present invention provides a lantern which includes a base, a telescopic shade, a top decorative cover, a handle and a connecting ring. A recess is formed on the lower part of the outside wall of the telescopic shade and a waterproof ring is inside the recess, which provides a waterproof structure. A vent hole is opened at the top so as to make the telescopic shade collapse freely, a guide through-hole is opened at the center of the upper cap of the base and the upper part of a socket support goes through that hole and can move up and down, a spring socket is formed on the lower part of the socket support and a spring is inside the socket, the elastic force of the spring can move the socket support up and down. A contact switch is disposed in the lantern circuit so that when the socket support moves up to make the bronze pieces on its both sides contact the bronze piece on the lower face of the upper cap of the base, the lantern circuit will turn-on and bulb will light-on; when the socket support is pressed down, the lantern will turn-off. The lantern can achieve the objective of the present invention.

BRIEF DESCRIPTION OF THE ACCOMPANYING DRAWINGS

The present invention comprises following accompanying drawings, in which.

DETAILED DESCRIPTION OF THE PREFERRED EMBODIMENTS

The embodiments of the present invention will be described in detail with reference to the accompanying drawings.

Figure 1:
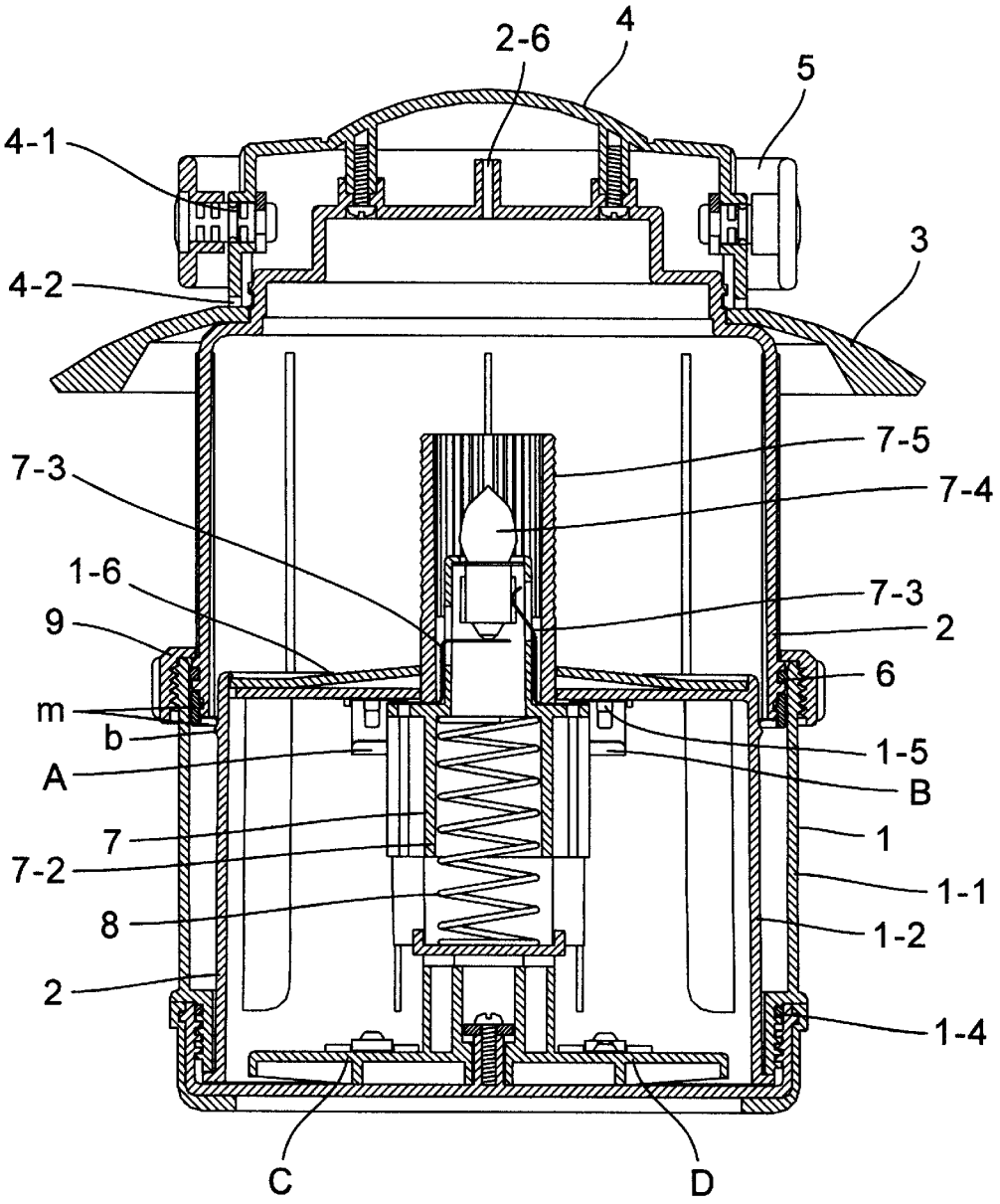
FIG. 1 shows the structure of the present invention FWCL.

FIG. 1 shows the structure of the present invention FWCL. It is a longitudinal section view which clearly describes the main structure and features of the present invention FWCL. The FWCL includes a base 1, a telescopic shade 2, a decorative cover 3, a top cover 4, a handle 5, a waterproof ring 6, a socket support 7, a spring 8 and a connecting ring 9, wherein the base 1 forms the lantern's lower half part housing and has a double shell overlapping structure with bottoms and a cylindrical shape. The outer housing 1-1 forms the outer shell of the base 1 which has an assembling structure including a bottom, a waterproof seal 1-4 is provided in the connecting portion of the assembly which makes the base 1 water-proof. The size of the inner housing 1-2 is slightly less than the outer housing 1-1, which is placed and fixed inside the outer housing 1-1 by means of its lower outward extension rim and forms double wall space S between the two housings. The inner housing 12 has upper cap, i.e. the upper cap of the base 1, and an opening is provided at the center of the cap, the upper part of the socket support 7 goes through the opening and can move up and down. The telescopic shade 2 has a cylindrical side wall at its middle and lower portion, and is inserted into the double wall space S and can move up and down along the walls so as to form a telescopic structure. A recess is formed on the lower part of the outside wall of the telescopic shade 2 and a waterproof ring 6, usually made of rubber, is inside the recess which provides a water-proof structure between the base 1 and telescopic shade 2. On the upper part of the telescopic shade 2 is provided a top portion which forms a step structure, at the lowest step is provided a decorative cover 3 which is made of transparent patterns and plays a decorative role, a small tube on the center of the top of the telescopic shade 2 forms a vent hole 2-6, which can balance the air pressure difference between the atmosphere and lantern inside air pressure due to the inside volume change when collapsing action takes place so as to make the collapsing action easier. Cover 4 is placed on the top of the telescopic shade 2, the top cover 4 together with the decorative cover 3 can prevent the rain goes into the inside of the lantern through the vent hole 2-6. The lower periphery of the top cover 4 presses against the decorative cover 3 and fix it. Outside the top cover 4 is provided air holes 4-2 which can adjust the air pressure inside the lantern together with the hole 2-6, and the holes 4-1 is for mounting the handle 5 and makes the handle 5 movably connect with the top cover 4. The connecting ring 9 is mounted on the outside of the upper part of the base 1, i.e. the outer housing 1-1, with a screw on its inside wall, which can prevent the middle and lower side wall of the telescopic shade 2 from sliding out of the double wall space S by means of an inward rim on its upper face.

The socket support 7 has a step shape with a small diameter cylindrical upper part and a large diameter cylindrical lower part, and at the joint portion of the upper part and the lower part, the large cylindrical lower part is provided with a left/right side plate and a skeleton structure which can be used as a battery holder. Four size-1 batteries are used as power source in the present lantern. Bronze pieces 7-3 are disposed on the top face of the left/right side plate as a half of a contact switch and contact the two poles of the bulb 7-4. The bronze pieces 7-3 and the other half of the contact switch, i.e. bronze pieces 1-5 which is disposed on the lower face of the upper cap of the base 1, form a series circuit, so that when the socket support 7 rises up to its highest position, the bronze pieces 7-3 will contact the bronze pieces 1-5, the bulb 7-4 at the top of the socket support will light-on; and when the socket support 7 is pressed down, the bronze pieces 7-3 and 1-5 will separate from each other, the circuit breaks and the bulb 7-4 turns-off. On the large diameter lower part of the socket support 7, there is provided a spring socket 7-2 with a spring 8 therein. The spring 8 is a pressure spring and placed vertically. When the telescopic shade 2 is pulled up, the spring, 8 will push the socket support 7 upward to its highest position and the bulb 7-4 will light-on, at this time, the top cap of the telescopic shade 2 is higher than the top of the socket support 7. When the telescopic shade 2 is pushed down, its top cap will press the socket support 7 down against the spring 8 and make the spring 8 in pressed state.

The side wall of the telescopic shade 2 has a transparent structure for the light emitting.

In order to locate and fix the telescopic shade 2 at its lowest position when it is pushed down, on a corresponding position of the inner housing 1-2 there is provided a circular and smooth rim a, and on the lower end of the side wall of the telescopic shade 2 is disposed a inward swelling locating ring m. The locating ring m has a thin piece structure, its projection portion is uniformly distributed along a circle, the front end of the projection is also circular or sharp shaped. The locating ring m can be locked by rim a when it is pushed down across the rim a by a force, thus the telescopic shade can be located at the lowest position. We can use our hand to push the shade 2 down against the elastic force of spring 8 and resistance of the rim a, that is an easy job for any one. Similarly, a rim b is disposed on the outside of the upper part of the inner housing 1-2, it has same locating function as the rim a. When the telescopic shale 2 is pulled up and the locating ring m travels across the rim b, the rim on the telescopic shade 2 which forms a recess with a waterproof ring 6 therein will be stopped by the connecting ring 9, therefore the telescopic shade 2 can't be pulled out, due to the functions of rim b, the telescopic shade 2 won't fall down and can keep the lantern in its working or lighting state. After use, the telescopic shade 2 is pushed down, the side wall of the telescopic shade 2 will insert into the double wall space S and stop at its retracting position.

The power is supplied by batteries which are weather-proofed and placed around the large diameter tube portion of the lower part of the socket support 7, i.e. the spring socket 7-2 in base 1. Bronze pieces A, B, C, D fix the batteries and they have a common battery holding structure. The bronze pieces A, B are fixed on the lower face of the top plate of the inner housing 1-2, i.e. the lower face of the top cap of the base 1, and connect with the bronze piece 1-5; the bronze pieces C, D are fixed on the bottom cap of the outer housing 1-1 of the base 1, the housing 1-1 has an assembly structure, its bottom cap can be removed for changing batteries and bulb. Waterproof seal 1-4 is disposed between the housing 1-1 and the bottom cap for the purpose of water-proof.

A reflecting plate 1-6 is mounted on the upper face of the top cap of the inner housing 1-2; the reflecting plate 1-6 is slightly projecting upward for reflecting more light to the outside.

At the upper part of socket support 7, a transparent sleeve 7-5 fits over the small diameter tube, it has decorative and protective functions and can be used as a guide for the socket support 7 moving up and down.

The telescopic shade 2 and top cover 4 are bolted together.

When in use, the handle 5 is picked up by hand, the telescopic shade 2 is raised and pulled out of the double wall space S to its working position and fixed, the lantern lights on; after use, the telescopic shade 2 is pushed down, its locating ring m travels across the rim a, the lantern will turn-off and become non-operation state. Since the batteries are placed at the lower part of the lantern, the gravity center of the lantern is near the bottom of the base 1, so the lantern can float on the water surface stably and can be used as a floating lamp.

Figure 2:
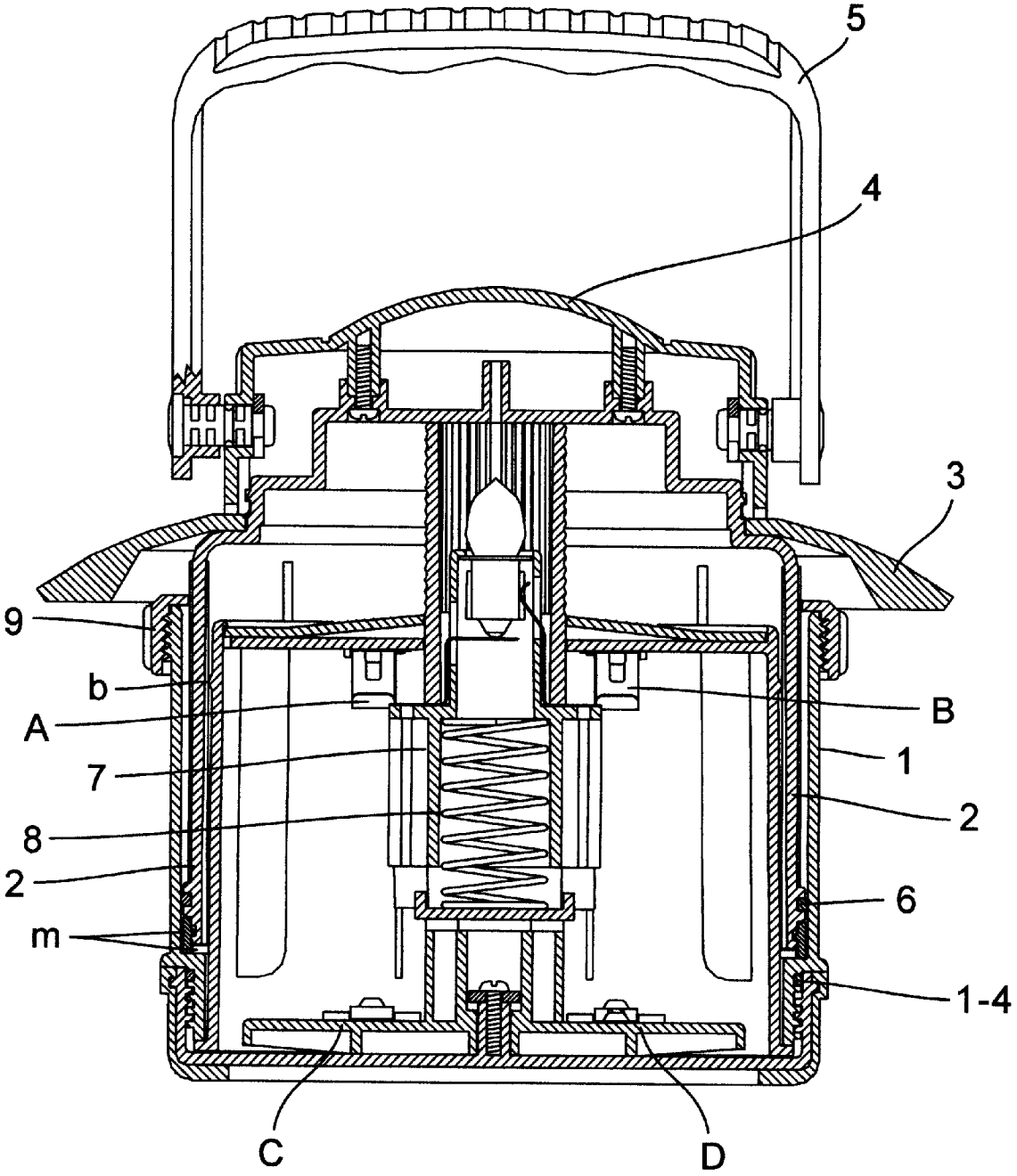
FIG. 2 shows the structure of the present invention FWCL in a non-operation condition.

FIG. 2 shows the non-operation condition of the present invention FWCL, wherein its telescopic shade 2 is pushed down and the locating ring m travels across the rim a. Since the most part of the side wall of the telescopic shade 2 goes into the double wall space S, the height of the lantern will reduce significantly which facilitates the handling and storage of the lanterns. The drawing also shows that the top cap of the telescopic shade 2 is pressing onto the top face of the socket support 7 and the spring 8 is in a retraction state.

Figure 3:
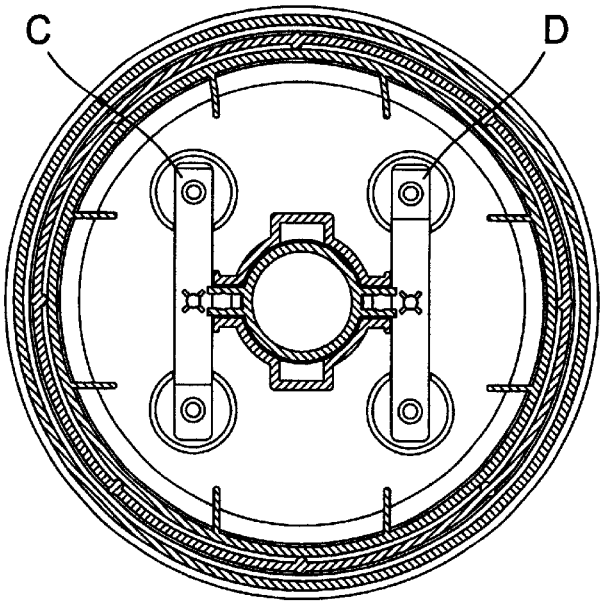
FIG. 3 shows the batteries arrangement of the present invention FWCL.

FIG. 3 is a top view of a cross section cut from the top face circular plate of the batteries of the present invention FWCL shown in FIGS. 1 and 2, it shows the installation of the batteries and the conditions of bronze pieces C and D connecting respectively to the batteries' bottom. As shown in the drawing, there are four batteries which are each placed in a corresponding cell and are connected with each other through bronze pieces.

Figure 4:
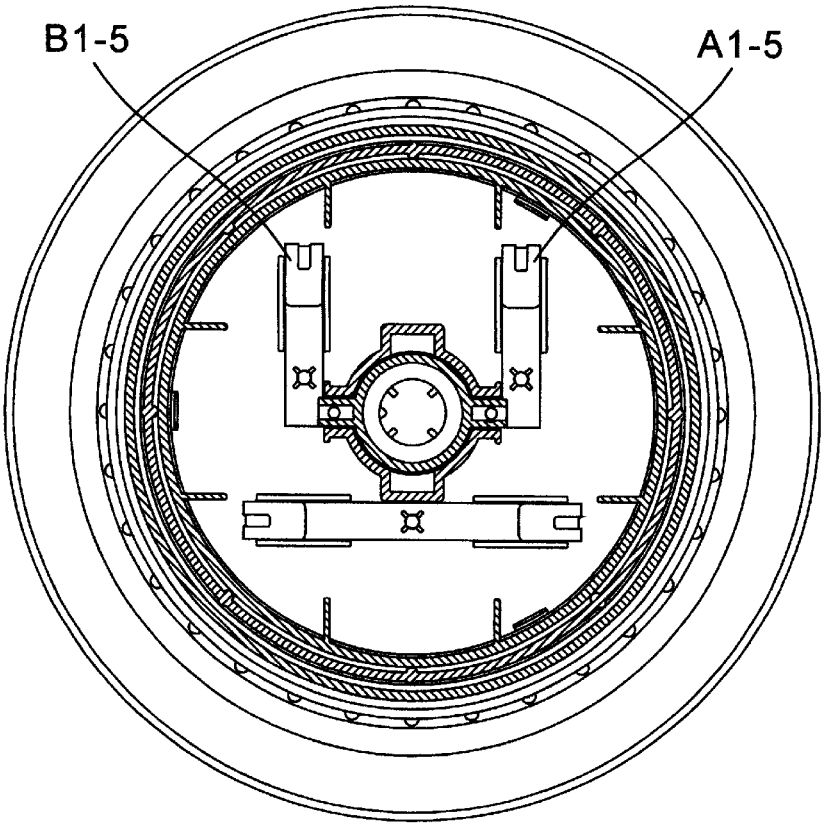
FIG. 4 shows the batteries and bronze pieces arrangement of the present invention FWCL.

FIG. 4 is a bottom view of a cross section cut from the top face circular plate of the batteries of the present invention FWCL shown in FIGS. 1 and 2, which shows the condition of the bronze pieces A and B connecting to the top face of the batteries. As shown in FIGS. 3 and 4, the four batteries are series connected. The bronze pieces A and B in FIG. 4 function as the bronze pieces 1-5 in the contact switch. When the socket support 7 is raised up to the working position by the spring 8, the bronze pieces 7-3 will contact the pieces 1-5, i.e. pieces A and B. and make the circuit turn-on and the lantern light on.

Figure 5:
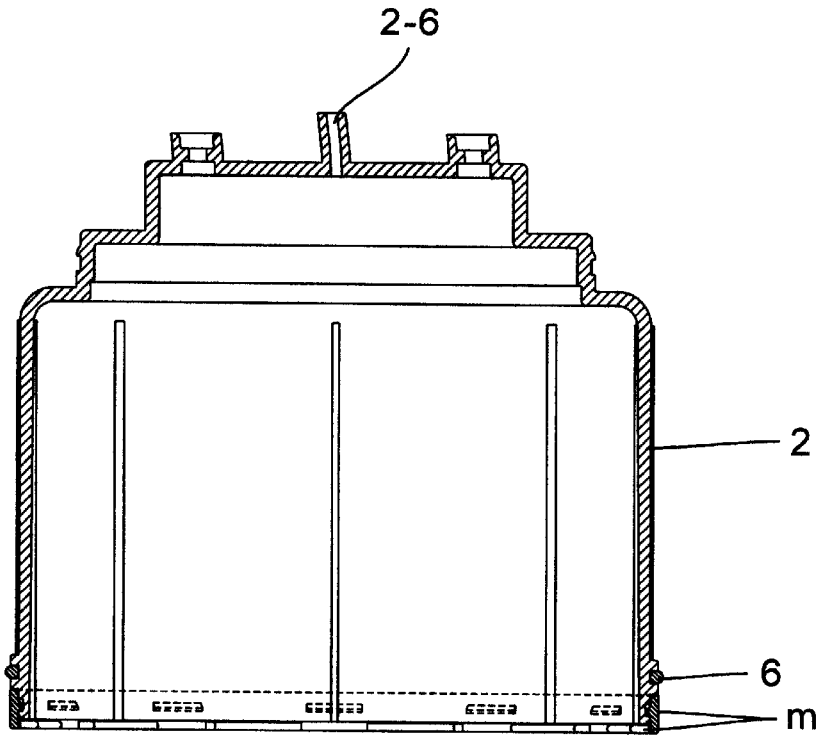
FIG. 5 shows the telescopic shade (2) structure of the present invention FWCL.

FIG. 5 is a section view and clearly shows the telescopic shade 2 structure of the present invention FWCL. Its main structure has shown in FIG. 1, and FIG. 5 particularly shows the arrangement of the locating ring m. The ring m is disposed on the lowest portion of the shade 2, its projection portions are uniformly spaced along a circle and used for locating. The drawing also clearly shows the installation of the waterproof ring 6 and the vent hole 2-6.

Figure 6:
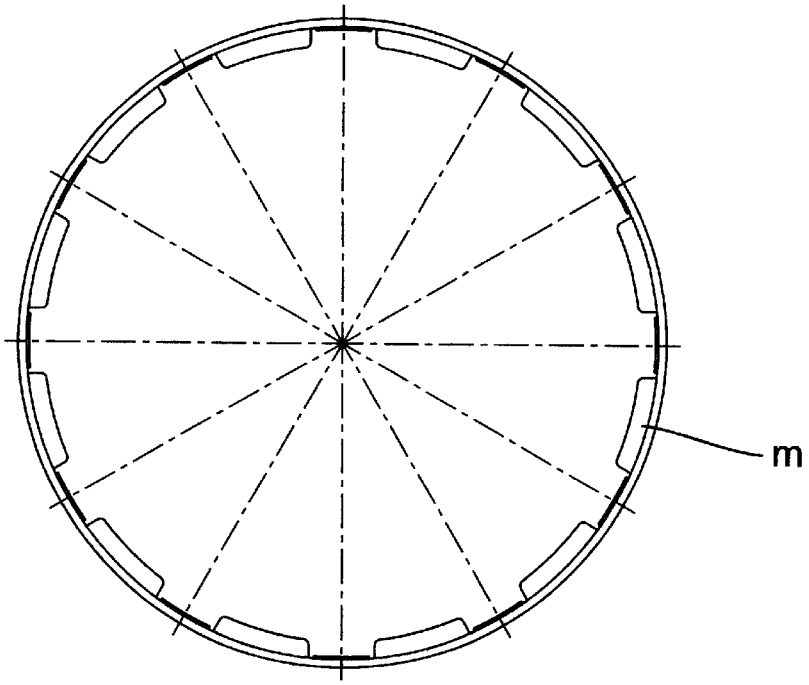
FIG. 6 shows the locating ring structure of the telescopic shade (2) of the present invention FWCL.

FIG. 6 is a top view of the locating ring m, it farther shows the structure of the locating ring m. The locating ring m has an annular structure and 12 lugs. The lugs are uniformly distributed along a circle and have a locating function.

Figure 7:
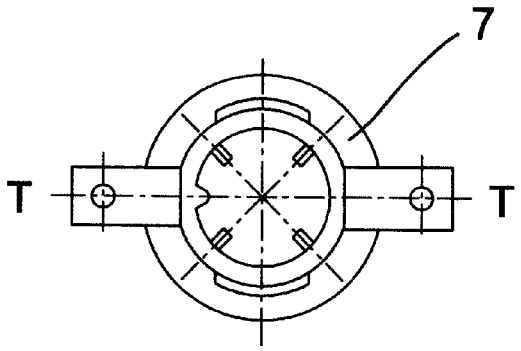
FIG. 7 shows the socket support (7) structure of the present invention FWCL.
Figure 7:
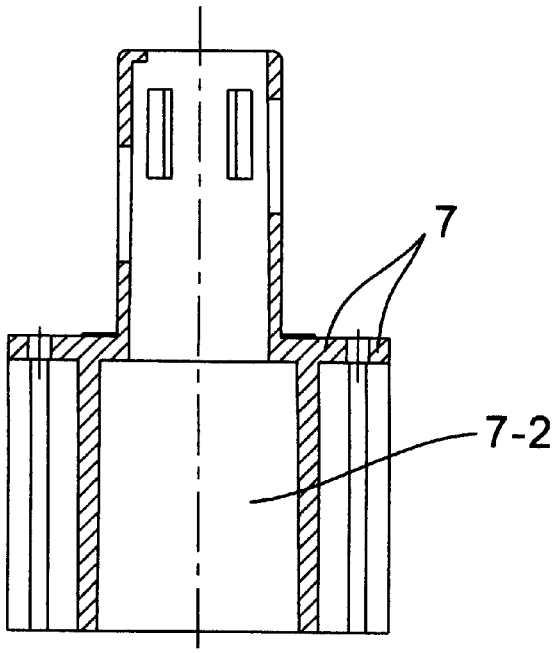

FIG. 7 shows the socket support 7 structure of the present invention FWCL. It comprises a top view 7A and a sectional view 7B. The socket support 7 includes an upper small-diameter tube part and lower large-diameter tube part, left/right side plate and bronze pieces 7-3. The bronze pieces 7-3 are placed on the side plates and act as contactors in the contact switch.

Figure 8:
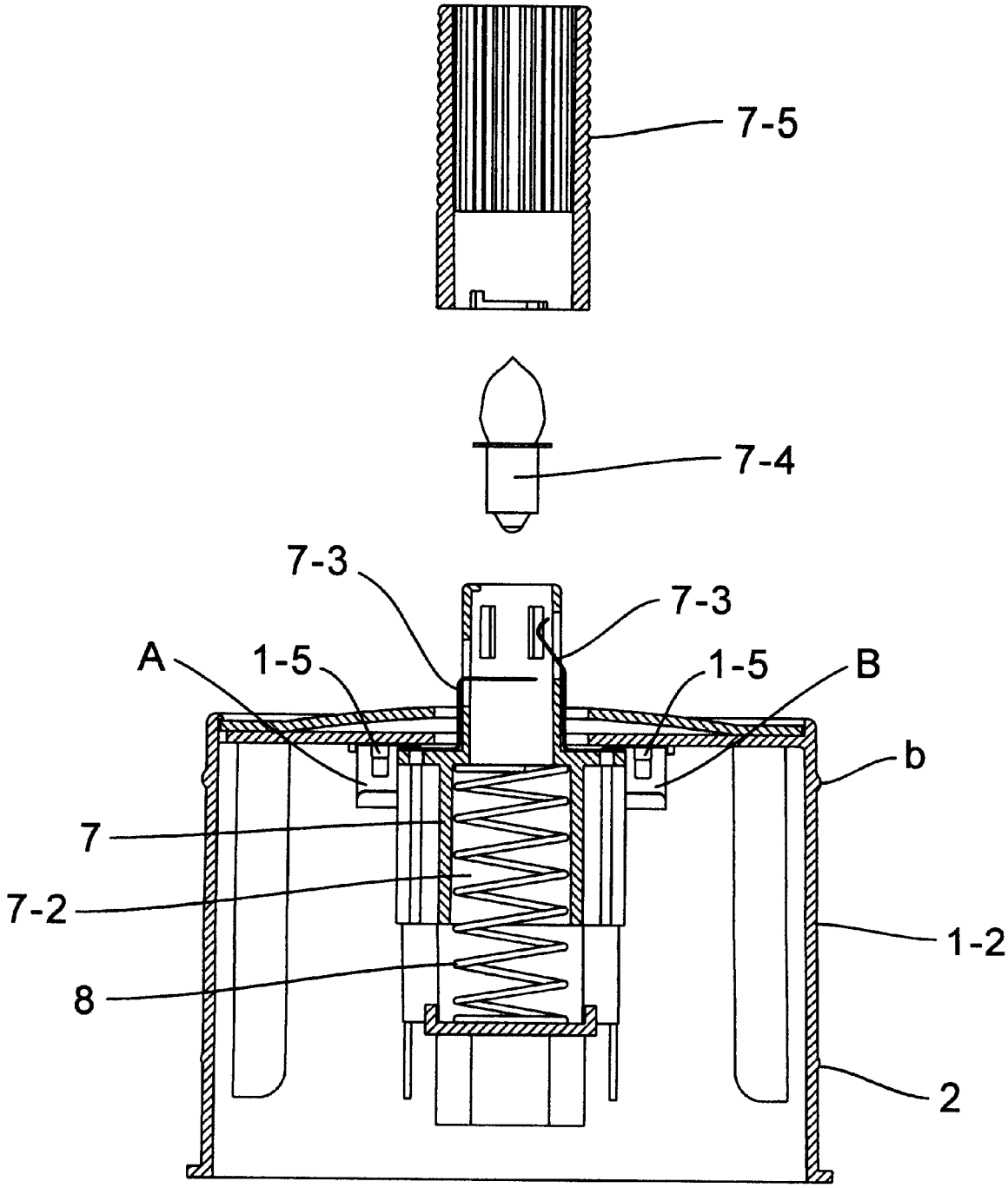
FIG. 8 shows the socket support (7) and inner housing (1-2) of the present invention FWCL.

FIG. 8 shows the structures and assembly relationship of the socket support 7 and inner housing 1-2 of the present invention FWCL. It further shows the matching of the support 7 and the housing 1-2, the structures and installation of the bulb 7-4, transparent sleeve 7-5 and bronze pieces 7-3. The bronze pieces 7-3 contact two poles of the bulb 7-4 respectively, then extend to the upper face of the left/right side plate of the support 7, when they contact the bronze pieces A and B, i.e. bronze pieces 1-5, the circuit turns-on. The drawing also clearly shows the appearances of the bulb and the transparent sleeve.

Figure 9:
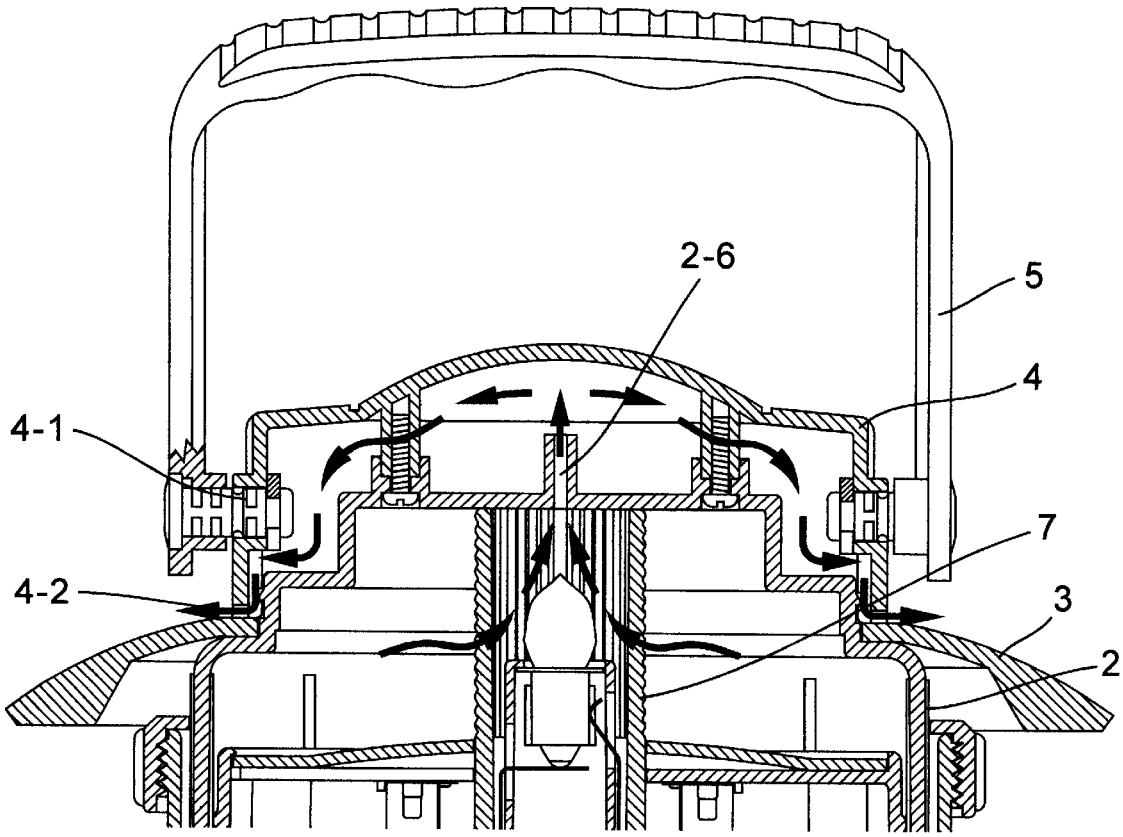
FIG. 9 shows the air path inside the FWCL of the present invention.

FIG. 9 shows the path of airflow of the present invention FWCL. Since the lantern is telescopic and waterproof, it should have a path for air going in and out. When the lantern is extended, the air will enter the lantern, and when the lantern is pressed down, the air will be expelled from the lantern. The air vents are disposed on the top of the telescopic shade 2 as well as two sides of the top cover 4, all of them are located at the upper part of the lantern and in the hiding places, therefore it can prevent the rain fall from going into the lantern. Black lines with arrow mark the air paths of the outward flow.

Figure 10:
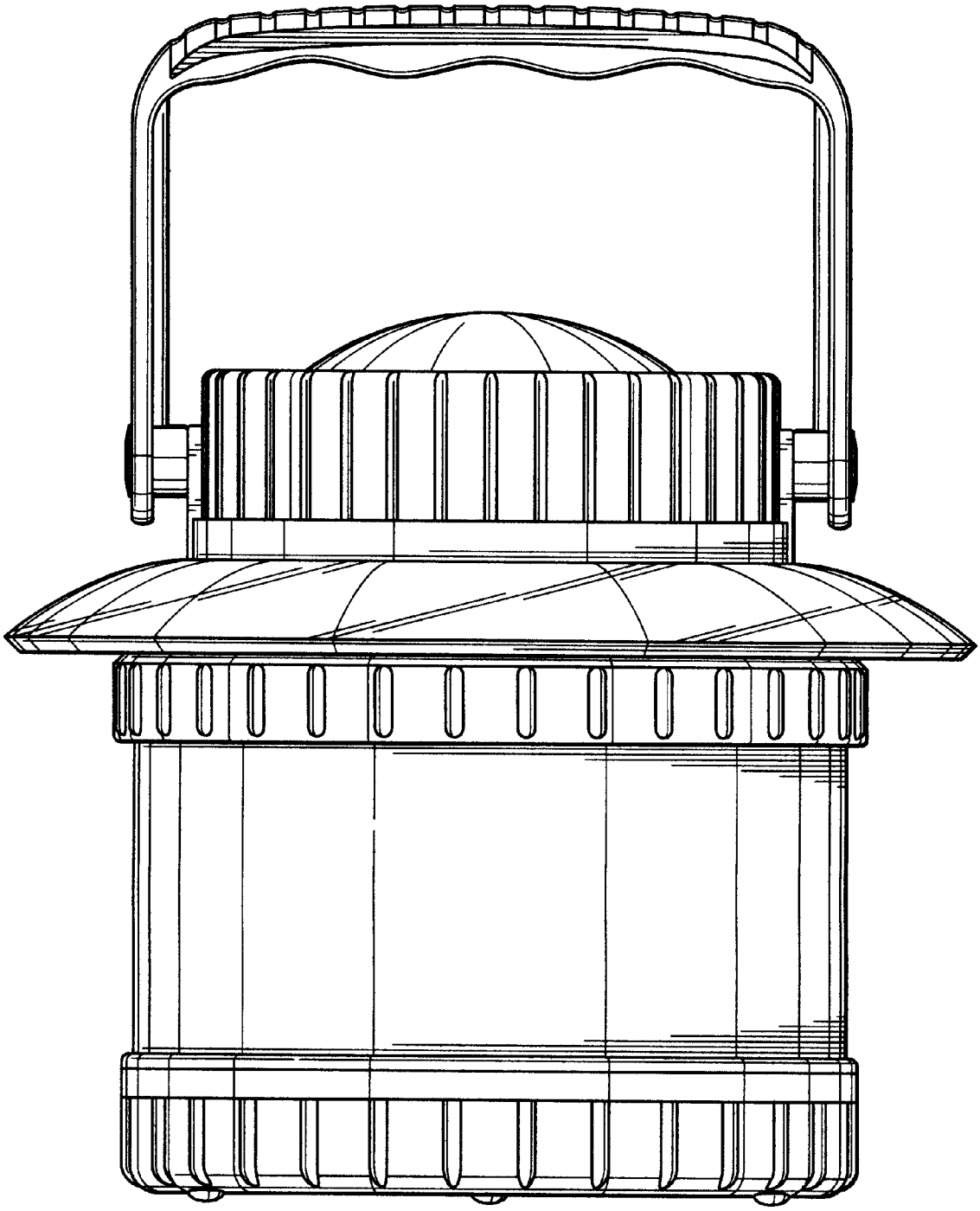
FIG. 10 shows the outward appearance of the present invention FWCL in a non-operation condition.

FIG. 10 shows the outward appearance of the FWCL in non-operation state of the present invention, in which the telescopic shade 2 is inserted into the double wall space S. From bottom to top, it shows the base 1, connecting ring 9, decorative cover 3, top cover 4 and handle 5. The present lantern has a beautiful appearance and compact structure.

Figure 11:
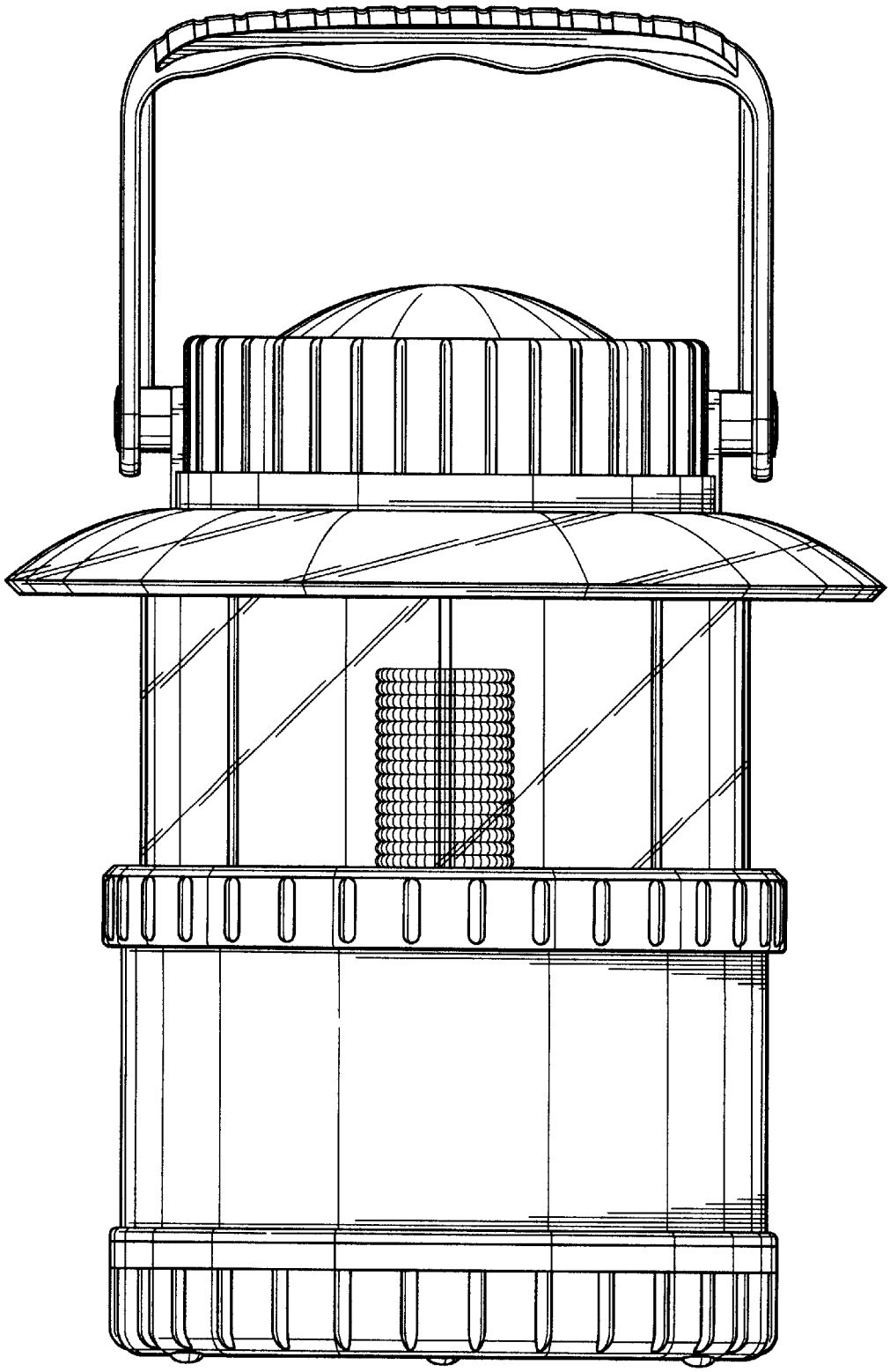
FIG. 11 shows the outward appearance of the present invention FWCL in working condition.

FIG. 11 shows the outward appearance of the FWCL in extension/working condition of the present invention. From bottom to top, it shows the base 1, connecting ring 9, telescopic shade 2, socket support 7, decorative cover 3, top cover 4 and handle 5. The light emits from the center of the upper part of the lantern through the transparent side wall of the telescopic shade 2 to the outside. Since the bulb is on the upper part, the gravity center of the lantern is on the lower part and the lantern is provided with a water-proof structure, the rainfall and water cannot enter the lantern, and it can stably float on the water surface and can be used as floating lamp. Furthermore, since the power is supplied by batteries and the lantern has a transparent protecting side wall of the telescopic shade 2, it can withstand wind blow and rain fall so that it has a wide use.

What is claimed is:

1. A floatable, waterproof and telescopic lantern, comprising:

a base; a telescopic shade; a top cover; a handle; a socket support and a connecting ring; wherein the base has a double shell overlapping and cylindrical shape structure and forms the lower part housing of the lantern, the double wall having an inner housing and outer housing and forms a double wall space between the inner and outer housings; the telescopic shade is disposed in the double wall space and can be pulled out and pushed in along the double wall, has a transparent side wall and a cover mounted on its top; holes is opened on the outside of the top cover and the handle as a pickup-arm movably connects with the top cover through the holes; the socket support goes through the opening at the center of the upper cap of the base and can move up and down; the connecting ring is mounted on the outside of the upper part of the base and can prevent the telescopic shade from sliding out of the double wall space by means of its upper inward rim, characterized in that said lantern farther includes a waterproof ring, the waterproof ring is disposed in the recess of the lower part of the telescopic shade so as to form a waterproof structure of the lantern; a spring socket is formed on the lower part of the socket support and a spring is placed therein; and a vent hole is opened at the top of the telescopic shade; on the socket support is provided bronze pieces for connecting with the bulb and lower face of the upper cap of the base is provided with bronze pieces so as to form a contact switch circuit together with the base, telescopic shade, socket support and spring, when the telescopic shade is pulled up and the socket support is pushed to its highest position by spring force, the bronze pieces on the socket support will contact the bronze pieces on the lower face of the upper cap of the base so that the circuit is turn-on and the bulb light-on, at this time, the position of the top cap of the telescopic shade is higher than the top of the socket support; and when the telescopic shade is pushed down, its top cap will press the socket support down and make the support separate from the upper cap of the base, thus the circuit is turn-off and the bulb light-off, at this time the spring is in a pressed state.

2. The lantern of claim 1, wherein on the upper part of the telescopic shade there is provided with a cap which has a step structure and the lowest step is provided with a decorative cover.

3. The lantern of claim 2, wherein the side wall of the top cover is provided with vent holes.

4. The lantern of claim 1, wherein the spring is a pressure spring and is placed vertically.

5. The lantern of claim 1, wherein the outside of the inner housing of the base is provided with rims which have circular and smooth shapes, and a locating ring is disposed on the lowest portion of the outer housing, said rims cooperate with said locating ring and play a locating function.

6. The lantern of claim 5, wherein the lower end of the outside wall of the telescopic shade is provided with a inward projecting locating ring, it has a circular thin piece structure, its lugs are uniformly distributed along the circle and have a circular or sharp shape front end, said locating ring cooperates with the rims on the outside of the inner housing of the base to play a locating function.

7. The lantern of claim 1, wherein the outer housing of the base has an assembly structure with a bottom cap, and at the joint place of the bottom cap there is provided with a water-proof seal.

8. The lantern of claim 1, wherein the top of the inner housing is provided with an upward projecting reflecting plate.

* * * * *